US011713900B2

(12) United States Patent
Sakaguchi et al.

(10) Patent No.: US 11,713,900 B2
(45) Date of Patent: Aug. 1, 2023

(54) CONTROL DEVICE, HEAT SOURCE SYSTEM, METHOD FOR CALCULATING LOWER LIMIT OF COOLING WATER INLET TEMPERATURE, CONTROL METHOD, AND PROGRAM

(71) Applicant: MITSUBISHI HEAVY INDUSTRIES THERMAL SYSTEMS, LTD., Tokyo (JP)

(72) Inventors: Katsuya Sakaguchi, Tokyo (JP); Satoshi Nikaido, Tokyo (JP); Yutaka Takenaka, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 176 days.

(21) Appl. No.: 17/269,061

(22) PCT Filed: Jun. 28, 2019

(86) PCT No.: PCT/JP2019/025915
§ 371 (c)(1),
(2) Date: Feb. 17, 2021

(87) PCT Pub. No.: WO2020/054181
PCT Pub. Date: Mar. 19, 2020

(65) Prior Publication Data

US 2021/0310687 A1 Oct. 7, 2021

(30) Foreign Application Priority Data

Sep. 13, 2018 (JP) ..... 2018-171726

(51) Int. Cl.
*F24F 11/83* (2018.01)
*F24F 5/00* (2006.01)
(Continued)

(52) U.S. Cl.
CPC ..... *F24F 11/83* (2018.01); *F24F 5/00* (2013.01); *F25B 1/00* (2013.01); *F28F 27/00* (2013.01)

(58) Field of Classification Search
CPC ..... F24F 5/0003; F25B 25/005; F25B 49/027; F25B 2339/07; F25B 2600/021; F25B 2600/111; F25B 2600/13
See application file for complete search history.

(56) References Cited

U.S. PATENT DOCUMENTS 4,325,223 A * 4/1982 Cantley ..... F25B 49/02 702/182
5,040,377 A 8/1991 Braun et al.
(Continued)

FOREIGN PATENT DOCUMENTS

CN 102353120 A 2/2012
CN 104838213 A 8/2015
(Continued)

OTHER PUBLICATIONS

Mitchel Howard, Methods of calculating Thermal heat load published Jun. 2018 (Year: 2018).*
(Continued)

*Primary Examiner* — Nelson J Nieves
*Assistant Examiner* — Meraj A Shaikh
(74) *Attorney, Agent, or Firm* — Birch, Stewart, Kolasch & Birch, LLP

(57) ABSTRACT

The purpose of the invention is to provide a control device that can calculate the lower limit of cooling water inlet temperature according to the operation status of a chiller. A control device comprises: a lower limit calculation unit that calculates the lower limit of cooling water outlet temperature, where a prescribed required temperature difference is added to the cooling water outlet temperature of a chiller,
(Continued)

and an inlet-outlet required temperature difference, which is the difference between the cooling water outlet temperature and the cooling water inlet temperature in the chiller and which is generated according to the operation status of the chiller, and that calculates a cooling water inlet temperature lower limit calculated value for the chiller by subtracting the inlet-outlet required temperature difference from the cooling water outlet temperature lower limit value; and a lower limit value determination unit that fixes the cooling water inlet temperature lower limit calculated value as the cooling water inlet temperature lower limit value.

8 Claims, 4 Drawing Sheets

(51) Int. Cl.
*F25B 1/00* (2006.01)
*F28F 27/00* (2006.01)

(56) References Cited

U.S. PATENT DOCUMENTS

2011/0030405 A1* 2/2011 Ueda ..... F25B 29/003 62/238.7
2015/0354849 A1* 12/2015 Matsuo ..... F25B 25/005 62/181
2016/0216024 A1* 7/2016 Yokoyama ..... F25B 49/02
2016/0290674 A1* 10/2016 Tateishi ..... F24D 19/1006

FOREIGN PATENT DOCUMENTS

| | | | |
|---|---|---|---|
| CN | 105972784 | A | 9/2016 |
| JP | 2000-337729 | A | 12/2000 |
| JP | 2004-150733 | A | 5/2004 |
| JP | 2005-155373 | A | 6/2005 |
| JP | 2007-298235 | A | 11/2007 |
| JP | 2010-54152 | A | 3/2010 |
| JP | 2014-149110 | A | 8/2014 |
| JP | 2318-60287 | A | 4/2016 |
| JP | 2318-4097 | A | 1/2018 |
| JP | 6334230 | B2 | 5/2018 |
| KR | 10-2013-0117117 | A | 10/2013 |

OTHER PUBLICATIONS

International Search Report for International Application No. PCT/JP2019/025915, dated Sep. 10, 2019 with an English translation.
Written Opinion of the International Searching Authority for International Application No. PCT/JP2019/025915, dated Sep. 10. 2019 with an English translation.

* cited by examiner

CONTROL DEVICE, HEAT SOURCE SYSTEM, METHOD FOR CALCULATING LOWER LIMIT OF COOLING WATER INLET TEMPERATURE, CONTROL METHOD, AND PROGRAM

TECHNICAL FIELD

The present invention relates to a control device, a heat source system, a method for calculating a lower limit of a cooling water inlet temperature, a control method, and a program.

Priority is claimed to Japanese Patent Application No. 2018-171726, filed Sep. 13, 2018, the contents of which are incorporated herein by reference.

BACKGROUND ART

In a control device that controls a cooling tower, a cooling water inlet temperature is controlled to be maintained at a target value or more with a temperature obtained by adding a correction value to a predetermined lower limit of the cooling water inlet temperature set for each chiller as the target value (PTL 1). However, in reality, when a cooling water outlet temperature of the chiller can be ensured at a defined value or more, the lower limit of the cooling water inlet temperature may be lowered from the predetermined lower limit depending on an operating status of the chiller. When the cooling water inlet temperature can be lowered to a possible range, a coefficient of performance (COP) of the chiller is improved.

CITATION LIST

Patent Literature

[PTL 1] Japanese Patent No. 6334230

SUMMARY OF INVENTION

Technical Problem

In order to operate the chiller efficiently, there is a demand for a method for calculating an appropriate cooling water inlet temperature according to the operating status of the chiller.

The present invention provides a control device, a heat source system, a method for calculating a lower limit of a cooling water inlet temperature, a control method, and a program capable of solving the above-mentioned problems.

Solution to Problem

According to one aspect of the present invention, a control device calculates a lower limit of a cooling water temperature. The control device includes a lower limit calculation unit that calculates a cooling water outlet temperature lower limit obtained by adding a predetermined required temperature difference to a setting value of a chilled water outlet temperature in a chiller and an inlet/outlet required temperature difference, which is a temperature generated according to an operating status of the chiller between a cooling water outlet temperature and a cooling water inlet temperature in the chiller, and subtracts the inlet/outlet required temperature difference from the cooling water outlet temperature lower limit to calculate a cooling water inlet temperature lower limit calculated value of the chiller, and a lower limit determination unit that determines the cooling water inlet temperature lower limit calculated value as a cooling water inlet temperature lower limit.

According to one aspect of the present invention, in the control device, the lower limit calculation unit calculates the inlet/outlet required temperature difference based on a load factor of the chiller during operation.

According to one aspect of the present invention, in the control device, the lower limit calculation unit calculates the inlet/outlet required temperature difference based on an amount of exhaust heat of the chiller during operation.

According to one aspect of the present invention, in the control device, the lower limit calculation unit further calculates the inlet/outlet required temperature difference based on a value obtained by subtracting a predetermined safety factor from a load factor of the chiller during operation.

According to one aspect of the present invention, the control device further includes a lower limit command unit that commands a cooling tower that supplies the cooling water to set the cooling water inlet temperature lower limit determined by the lower limit determination unit to a lower limit of the cooling water inlet temperature.

According to one aspect of the present invention, in the control device, the lower limit calculation unit calculates the cooling water inlet temperature lower limit calculated value in a predetermined control cycle, and the lower limit command unit provides a command on the cooling water inlet temperature lower limit.

According to one aspect of the present invention, a heat source system includes a chiller, the control device that controls the chiller, a cooling tower that supplies cooling water to the chiller, and a control device of the cooling tower. The control device of the cooling tower updates a target temperature of the cooling water at an inlet of the chiller based on the cooling water inlet temperature lower limit as commanded by the lower limit command unit.

According to one aspect of the present invention, a method for calculating a lower limit of a cooling water inlet temperature includes a step of calculating a cooling water outlet temperature lower limit obtained by adding a predetermined required temperature difference to a chilled water outlet temperature in a chiller, a step of calculating an inlet/outlet required temperature difference which is a temperature generated according to an operating status of the chiller between a cooling water outlet temperature and a cooling water inlet temperature in the chiller, a step of subtracting the inlet/outlet required temperature difference from the cooling water outlet temperature lower limit to calculate a cooling water inlet temperature lower limit calculated value of the chiller, and a step of determining the cooling water inlet temperature lower limit calculated value as a cooling water inlet temperature lower limit.

According to one aspect of the present invention, a control method includes, in a heat source system including a cooling tower and a chiller, calculating a lower limit of a temperature of cooling water at an inlet of the chiller by the method for calculating the lower limit of the cooling water inlet temperature, and updating a target temperature of the cooling water supplied by the cooling tower at the inlet of the chiller based on the calculated lower limit.

According to one aspect of the present invention, a program causing a computer to function as means for calculating a cooling water outlet temperature lower limit obtained by adding a predetermined required temperature difference to a chilled water outlet temperature in a chiller, means for calculating an inlet/outlet required temperature difference which is a temperature generated according to an operating status of the chiller between a cooling water outlet temperature and a cooling water inlet temperature in the chiller, means for subtracting the inlet/outlet required temperature difference from the cooling water outlet temperature lower limit to calculate a cooling water inlet temperature lower limit calculated value of the chiller, and means for determining the cooling water inlet temperature lower limit calculated value as a cooling water inlet temperature lower limit.

Advantageous Effects of Invention

With the control device, the heat source system, the method for calculating the lower limit of the cooling water inlet temperature, the control method, and the program described above, it is possible to calculate the lower limit of the cooling water inlet temperature for improving the COP of the chiller.

DESCRIPTION OF EMBODIMENTS

Embodiment

Hereinafter, a method for calculating a lower limit of a cooling water inlet temperature according to an embodiment of the present invention will be described with reference to FIGS. 1 to 7.

Figure 1:
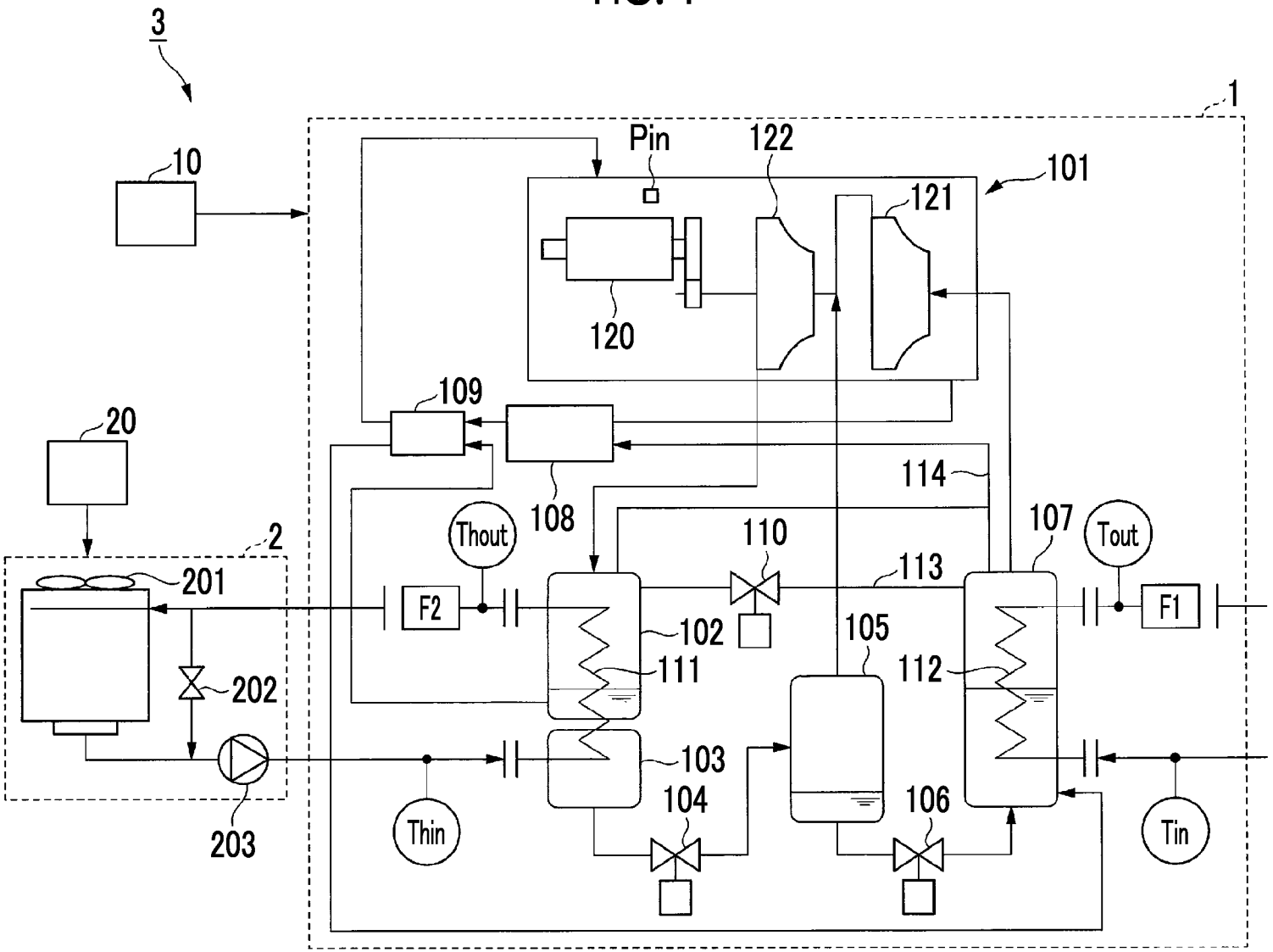
FIG. 1 is a diagram showing a configuration example of a heat source system according to an embodiment.

FIG. 1 is a diagram showing a configuration example of a heat source system according to an embodiment.

A heat source system 3 includes a chiller 1, a control device 10 for controlling the chiller 1, a cooling tower 2, and a control device 20 for controlling the cooling tower 2.

The chiller 1 includes a turbo compressor 101, a condenser 102, a subcooler 103, a high-pressure expansion valve 104, an economizer 105, a low-pressure expansion valve 106, an evaporator 107, an oil tank 108, an oil cooler 109, a hot gas bypass (HGBP) valve 110, a cooling heat transfer tube 111, a chilled water heat transfer tube 112, a hot gas bypass pipe 113, and the like. The turbo compressor 101 includes an electric motor 120, a first-stage compression portion 121 at a first stage, and a second-stage compression portion 122 at a second stage.

The turbo compressor 101 is a two-stage compressor and compresses a refrigerant gas. The condenser 102 condenses and liquefies the high-temperature and high-pressure refrigerant gas compressed by the turbo compressor 101. The subcooler 103 is provided on a downstream side of a refrigerant flow of the condenser 102 and supercools the liquid refrigerant condensed by the condenser 102. The cooling heat transfer tube 111 is inserted into the condenser 102 and the subcooler 103 to cool the refrigerant with cooling water flowing in the tube. The cooling water flowing through the cooling heat transfer tube 111 is supplied from the cooling tower 2. The cooling water cools the refrigerant and then is returned to the cooling tower 2 to dissipate heat in the cooling tower 2. The cooling water after the heat dissipation is supplied to the chiller 1 again and flows through the cooling heat transfer tube 111.

The high-pressure expansion valve 104 and the low-pressure expansion valve 106 decompress the liquid refrigerant from the subcooler 103. The economizer 105 cools the intermediate pressure refrigerant decompressed by the high-pressure expansion valve 104. The refrigerant is separated into a gas phase and a liquid phase by the economizer 105. The gas phase refrigerant is supplied to a medium pressure portion (suction side of the second-stage compression portion 122) of the turbo compressor 101. When the liquid phase refrigerant flows out of the economizer 105, the liquid phase refrigerant is further decompressed by the low-pressure expansion valve 106. The evaporator 107 evaporates the liquid refrigerant decompressed by the low-pressure expansion valve 106. The chilled water heat transfer tube 112 is inserted into the evaporator 107. Chilled water flowing through the chilled water heat transfer tube 112 is cooled by absorbing heat of vaporization when the refrigerant evaporates. The chiller 1 supplies the cooled chilled water to an external load (not shown).

The oil tank 108 is a container that recovers and stores chiller oil discharged from the compressor 101 together with the refrigerant to a refrigerant circuit. The oil tank 108 communicates with the evaporator 107 by a pipe 114. A pressure in the oil tank 108 communicates with a suction side of the compressor 101 and is maintained at the same low pressure as the suction side of the compressor 101. The pipe 114 is provided with an eductor (not shown) driven by the high-pressure refrigerant gas flowing from the condenser 102, and the chiller oil collected in the evaporator 107 is recovered in the oil tank 108 due to a pressure difference between the condenser 102 and the oil tank 108. The oil tank 108 has a built-in oil pump and discharges the chiller oil recovered from the evaporator 107. The chiller oil sent out by the oil pump is cooled by the oil cooler 109 and supplied to the compressor 101. A part of the refrigerant cooled by the condenser 102 is supplied to the oil cooler 109, and the refrigerant used for cooling the chiller oil is supplied to the evaporator 107.

The hot gas bypass pipe 113 is provided between a gas phase portion of the condenser 102 and a gas phase portion of the evaporator 107, and bypasses the refrigerant gas. The hot gas bypass valve 110 controls a flow rate of the refrigerant flowing in the hot gas bypass pipe 113. The hot gas bypass flow rate is adjusted to adjust a flow rate of the refrigerant sucked by the compressor 101 according to a load.

The control device 10 controls each unit. For example, the control device 10 starts the chiller 1 during stoppage or stops the chiller 1 during operation based on a control signal input from an upper control device. The control device 10 controls the electric motor 120 and the hot gas bypass valve 110 based on the control signal input from the upper control device to control the load of the chiller 1. With the load control performed by the control device 10, the chiller 1 supplies the chilled water controlled to a target temperature to the external load.

A cooling water flow rate is measured by a flow meter F2, a cooling water outlet temperature is measured by a temperature sensor Thout, and a cooling water inlet temperature is measured by a temperature sensor Thin. A chilled water flow rate is measured by a flow meter F1, a chilled water outlet temperature is measured by a temperature sensor Tout, and a chilled water inlet temperature is measured by a temperature sensor Tin. Input power to the electric motor 120 is measured by a power meter Pin. The measured values are used when the control device 10 controls each unit and are used by the control device 10 for calculating the lower limit of the cooling water inlet temperature.

The cooling tower 2 cools the cooling water used for cooling the refrigerant in the condenser 102. The control device 20 controls a rotation speed of a fan 201, opening/closing of a bypass valve 202, a rotation speed of a pump 203, and the like such that the cooling water temperature at the inlet of the chiller 1 becomes a predetermined target temperature, for example. In the chiller 1, a predetermined lower limit (cooling water inlet temperature lower limit setting value Thi0) is provided with respect to the cooling water inlet temperature for normal operation. The lower limit is set for each chiller 1. The control device 20 controls the operation of the cooling tower 2 and the like such that the temperature of the cooling water supplied to the condenser 102 does not decrease below the cooling water inlet temperature lower limit setting value Thi0. Hereinafter, the cooling water inlet temperature lower limit setting value Thi0 may be described as a lower limit setting value Thi0.

Figure 2:
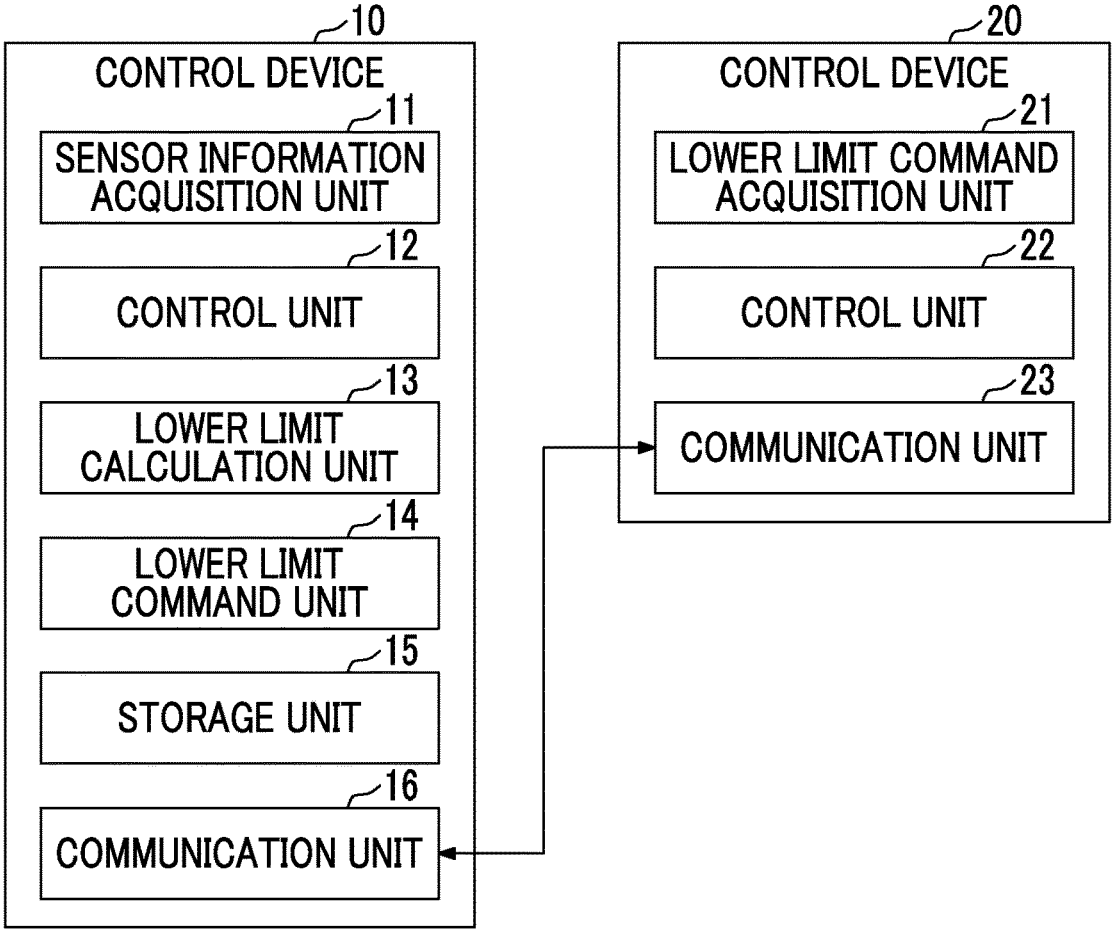
FIG. 2 is a block diagram showing an example of a control device of a chiller and a cooling tower according to an embodiment.

FIG. 2 is a block diagram showing an example of a control device of a chiller and a cooling tower according to an embodiment.

The control device 10 of the chiller 1 is configured of a computer such as a programmable logic controller (PLC) or a microcomputer. As shown in the figure, the control device 10 includes a sensor information acquisition unit 11, a control unit 12, a lower limit calculation unit 13, a lower limit command unit 14, a storage unit 15, and a communication unit 16.

The sensor information acquisition unit 11 acquires the flow rates measured by the flow meters F1 and F2, the temperatures measured by the temperature sensors Thin, Thout, Tin, and Tout, the power measured by the power meter Pin, and the like.

The control unit 12 controls a refrigerating cycle such as controlling the rotation speed of the compressor 101 or controlling an opening degree of the hot gas bypass valve 110, in addition to starting and stopping the chiller 1 as described above.

The lower limit calculation unit 13 calculates a cooling water inlet temperature lower limit calculated value Thi1 according to an operating status of the chiller 1. When the control unit 12 can decrease the temperature of the cooling water flowing through the condenser 102 in controlling the refrigerating cycle of the chiller 1, the COP can be improved. An excessive decrease in the cooling water temperature leads to a decrease in cooling capacity. Therefore, the lower limit setting value Thi0 is set in the chiller 1. However, the lower limit of the cooling water inlet temperature may be decreased below the predetermined lower limit setting value Thi0 depending on the operating status of the chiller 1. The lower limit calculation unit calculates the cooling water inlet temperature lower limit calculated value Thi1 according to an operating status of the chiller 1. Hereinafter, the cooling water inlet temperature lower limit calculated value Thi1 may be described as a lower limit calculated value Thi1.

The lower limit command unit 14 determines the lower limit calculated value Thi1 as a cooling water inlet temperature lower limit command value Thi2. Hereinafter, the cooling water inlet temperature lower limit command value Thi2 may be described as a lower limit command value Thi2. The lower limit command unit 14 commands the control device 20 of the cooling tower 2 to set the lower limit of the cooling water inlet temperature to the lower limit command value Thi2.

The storage unit 15 stores various data necessary for calculating the lower limit calculated value Thi1. For example, the storage unit 15 stores the lower limit setting value Thi0, a chilled water outlet temperature setting value Tset, a cooling water required outlet temperature $\alpha$, a required temperature difference $\beta$ between the chilled water outlet temperature and the cooling water outlet temperature, a cooling water rated temperature difference $\Delta$Thi, a cooling water rated flow rate Fset, and the like.

The communication unit 16 communicates with the control device 20 of the cooling tower 2.

The control device 20 of the cooling tower 2 is configured of a computer such as a PLC or a microcomputer. As shown in the figure, the control device 20 includes a lower limit command acquisition unit 21, a control unit 22, and a communication unit 23.

The lower limit command acquisition unit 21 acquires the lower limit command value Thi2 from the control device 10.

The control unit 22 controls the operation of the cooling tower 2. In the present embodiment, the control unit 22 controls the temperature of the cooling water such that the temperature of the cooling water does not decrease below the latest lower limit command value Thi2 acquired from the control device 10. For example, the control unit 22 controls the cooling water to reach a target temperature with a value obtained by adding a predetermined correction value to the lower limit command value Thi2 as the target temperature.

The communication unit 23 communicates with the control device 10 of the chiller 1.

Next, a process of calculating the lower limit calculated value Thi1 by the lower limit calculation unit 13 will be described with reference to FIGS. 3 to 5.

Example 1

Figure 3:
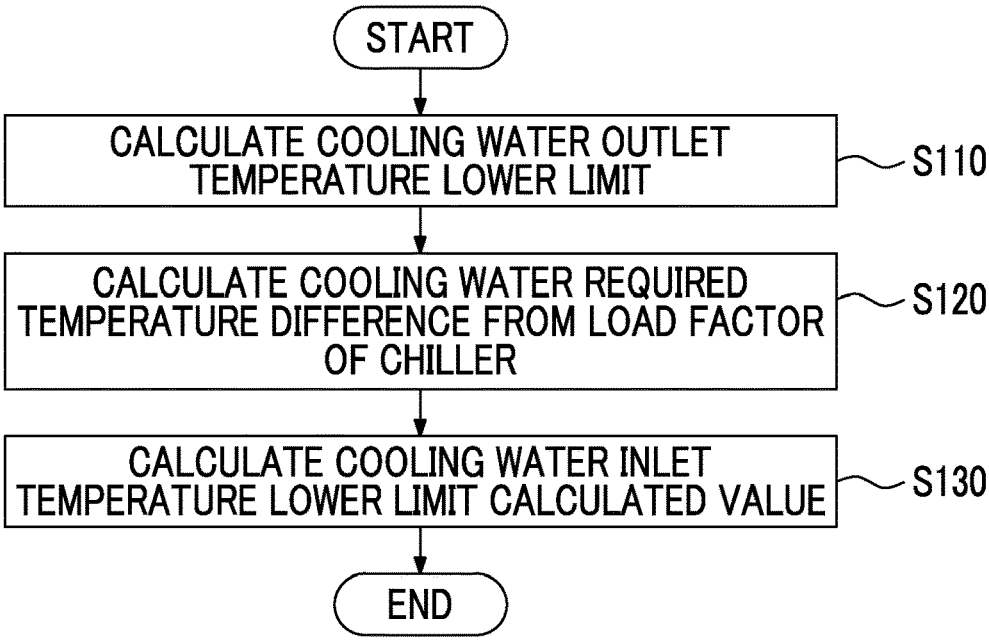
FIG. 3 is a first flowchart showing an example of a method for calculating a lower limit of a cooling water inlet temperature according to an embodiment.

FIG. 3 is a first flowchart showing an example of the method for calculating the lower limit of the cooling water inlet temperature according to an embodiment.

First, the lower limit calculation unit 13 calculates a cooling water outlet temperature lower limit Thomin (step S110). The lower limit calculation unit 13 reads the chilled water outlet temperature setting value Tset and the required temperature difference $\beta$ between the chilled water outlet temperature and the cooling water outlet temperature from the storage unit 15 and performs the following calculation.

Cooling water outlet temperature lower limit *Tho*min=Chilled water outlet temperature setting value *T*set+Required temperature difference $\beta$ (1)

Here, the chilled water outlet temperature setting value Tset is a value determined by the chilled water temperature required by the external load. The required temperature difference $\beta$ is a temperature difference required to ensure a differential pressure at the front and rear of the high-pressure expansion valve 104 and the low-pressure expansion valve 106 (differential pressure between the condenser 102 and the evaporator 107). The differential pressure at the front and rear of the high-pressure expansion valve 104 and the low-pressure expansion valve 106 is required to prevent carryover in the economizer 105. The required temperature difference β is a parameter set for each chiller 1.

The lower limit calculation unit 13 reads the cooling water required outlet temperature α from the storage unit 15 and sets the cooling water outlet temperature lower limit Thomin such that the following relationship is satisfied.

Cooling water outlet temperature lower limit Thomin≥Cooling water required outlet temperature α (2)

When the temperature of the oil tank 108 becomes low, the chiller oil recovered in the oil tank 108 accumulates in the refrigerant and a required amount of chiller oil cannot be returned to the compressor 101. A temperature required for the oil tank 108 is designed with reference to the cooling water outlet temperature. The cooling water required outlet temperature α is a temperature required to prevent the chiller oil from accumulating in the refrigerant in the oil tank 108. The cooling water required outlet temperature α is a parameter set for each chiller 1. When the cooling water outlet temperature lower limit Thomin calculated by equation (1) is less than the cooling water required outlet temperature α, the lower limit calculation unit 13 sets the cooling water required outlet temperature α to the cooling water outlet temperature lower limit Thomin.

Next, the lower limit calculation unit 13 calculates a cooling water required temperature difference from a load factor of the chiller (step S120). The lower limit calculation unit 13 reads the cooling water rated temperature difference ΔThi from the storage unit 15. The lower limit calculation unit 13 calculates a load factor Kmin of the chiller 1 during operation. The lower limit calculation unit 13 calculates a cooling water required temperature difference ΔThmin by the following equation.

Cooling water required temperature difference $\Delta Th$min=Cooling water rated temperature difference $\Delta Thi$×Load factor $K$min (3)

The load factor Kmin is calculated as follows.

Load factor $K$min=Temperature difference between chilled water inlet/outlet temperatures×Chilled water flow rate×Specific heat×Specific gravity={(Temperature measured by temperature sensor $T$in−Temperature measured by temperature sensor $T$out)×Flow rate measured by flow meter $F1$×Specific heat×Specific gravity}=Rated load (4)

The cooling water rated temperature difference ΔThi and the rated load are recorded in advance in the storage unit 15.

Next, the lower limit calculation unit 13 calculates the cooling water inlet temperature lower limit calculated value (step S130). The lower limit calculation unit 13 reads the cooling water rated flow rate Fset from the storage unit 15. The lower limit calculation unit 13 calculates the lower limit calculated value Thi1 by the following equation.

Cooling water inlet temperature lower limit calculated value $Thi1$=Cooling water outlet temperature lower limit $Tho$min−(Cooling water required temperature difference $\Delta Th$min×Cooling water rated flow rate $F$set=Cooling water flow rate measured by flow meter $F2$) (5)

As described above, the cooling water inlet/outlet temperature difference, which is the temperature between the cooling water outlet temperature and the cooling water inlet temperature generated according to a load status of the chiller 1 during operation, is subtracted from the cooling water outlet temperature lower limit based on the chilled water outlet temperature setting value Tset required by the external load and the required temperature difference and thus it is possible to calculate the cooling water inlet temperature lower limit calculated value Thi1 according to the load status of the chiller 1 during operation.

Example 2

Further, the lower limit calculation unit 13 may calculate the lower limit calculated value Thi1 as follows.

Figure 4:
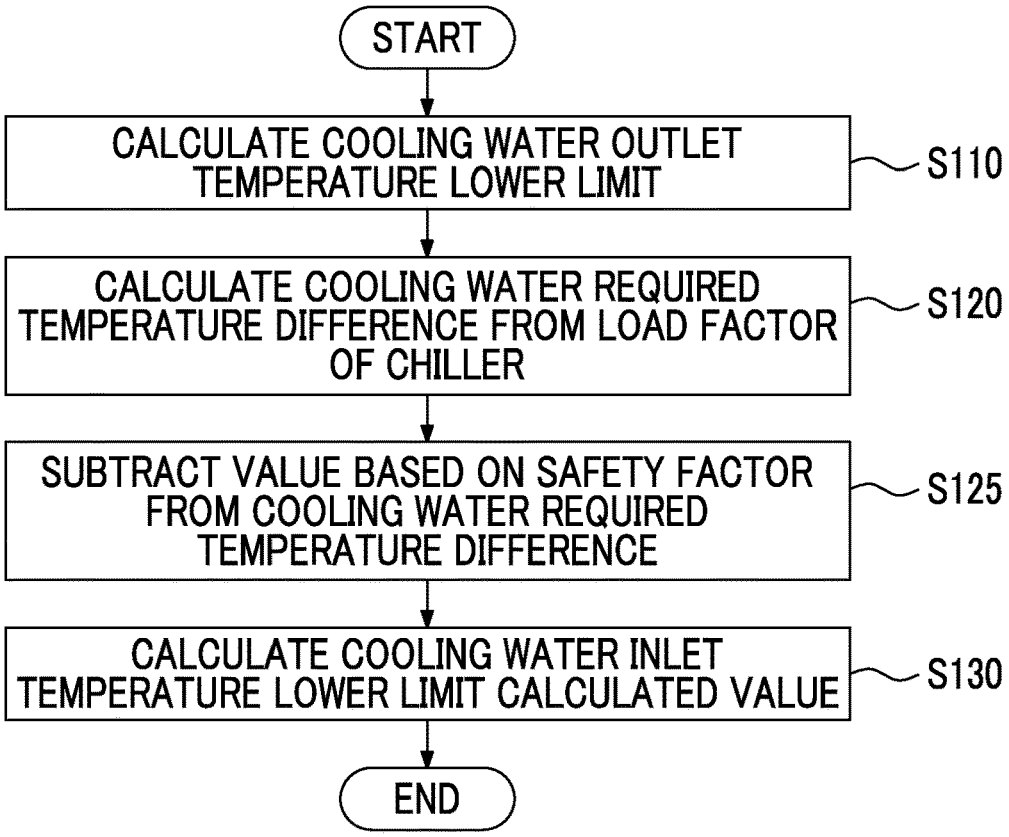
FIG. 4 is a second flowchart showing an example of the method for calculating the lower limit of the cooling water inlet temperature according to an embodiment.

FIG. 4 is a second flowchart showing an example of the method for calculating the lower limit of the cooling water inlet temperature according to an embodiment.

The same reference numeral is assigned to the same process as in FIG. 3 and the same process will be briefly described.

First, the lower limit calculation unit 13 calculates the cooling water outlet temperature lower limit Thomin (step S110). The lower limit calculation unit 13 calculates the cooling water outlet temperature lower limit Thomin by the above equation (1). However, the cooling water outlet temperature lower limit Thomin is required to be equal to or larger than the cooling water required outlet temperature α.

Next, the lower limit calculation unit 13 calculates the cooling water required temperature difference from the load factor of the chiller (step S120). The lower limit calculation unit 13 calculates the cooling water required temperature difference ΔThmin by the above equations (3) and (4).

Next, the lower limit calculation unit 13 subtracts a value based on a predetermined safety factor from the cooling water required temperature difference ΔThmin calculated in step S120 (step S125).

Cooling water required temperature difference $\Delta Th$min'=Cooling water required temperature difference $\Delta Th$min−Value based on safety factor $D$ (6)

The value based on the safety factor D is a value set in consideration of a case where the load of the chiller 1 suddenly decreases. The safety factor D is set with respect to the load factor of the chiller 1, and the cooling water required temperature difference ΔThmin' is calculated by the following equation (6') in more detail.

Cooling water required temperature difference $\Delta Th$min'=Cooling water rated temperature difference $\Delta Thi$×(Load factor $K$min−Safety factor $D$) (6')

The safety factor D and the value based on the safety factor D are recorded in the storage unit 15 in advance.

Next, the lower limit calculation unit 13 calculates the cooling water inlet temperature lower limit calculated value (step S130). The lower limit calculation unit 13 calculates the lower limit calculated value Thi1 by using the cooling water required temperature difference ΔThmin' instead of the cooling water required temperature difference ΔThmin in the above equation (5).

Cooling water inlet temperature lower limit calculated value $Thi1$=Cooling water outlet temperature lower limit $Tho$min−(Cooling water required temperature difference $\Delta Th$min'×Cooling water rated flow rate $F$set=Cooling water flow rate measured by flow meter $F2$) (5')

In Example 2, the value based on the safety factor D is subtracted from the cooling water required temperature difference ΔThmin. That is, the lower limit calculated value Thi1 has a high temperature as compared with the method in Example 1. As can be seen from the equations (3) and (5), the higher the load factor of the chiller 1, the smaller the lower limit calculated value Thi1. When the load factor of the chiller 1 suddenly decreases from a high state, the lower limit calculated value Thi1 allowed after the decrease becomes higher than the lower limit calculated value Thi1 before the decrease. That is, there is a possibility that the temperature control of the cooling water based on the lower limit calculated value Thi1 (to be exact, the lower limit command value Thi2) according to the load factor after the decrease is not performed in time after the sudden decrease in the load and thus cooling water below a correct lower limit calculated value Thi1 is supplied. With this, there is a possibility that the refrigerant pressure decreases excessively in the condenser 102 and the subcooler 103, the required pressure difference at the front and rear of the high-pressure expansion valve 104 and the low-pressure expansion valve 106 cannot be obtained, and the refrigerating cycle of the chiller 1 does not function normally. Therefore, in Example 2, the value based on the safety factor D is subtracted from the cooling water required temperature difference ΔThmin for the purpose of providing a buffer to cope with the sudden decrease in the load. With the method for calculating the lower limit of the cooling water inlet temperature in Example 2, it is possible to calculate a safer lower limit calculated value Thi1 that improves the COP of the chiller 1.

In the flowchart of FIG. 4, an example of subtracting the value based on the predetermined safety factor D set for the sudden decrease in the load of the chiller 1 from the cooling water required temperature difference ΔThmin has been described. However, the value based on the safety factor D may be set as a ratio smaller than one and multiplied by the cooling water required temperature difference ΔThmin.

Example 3

Further, the lower limit calculation unit 13 may calculate the lower limit calculated value Thi1 based on an amount of exhaust heat from the chiller 1 instead of the load factor of the chiller 1.

Figure 5:
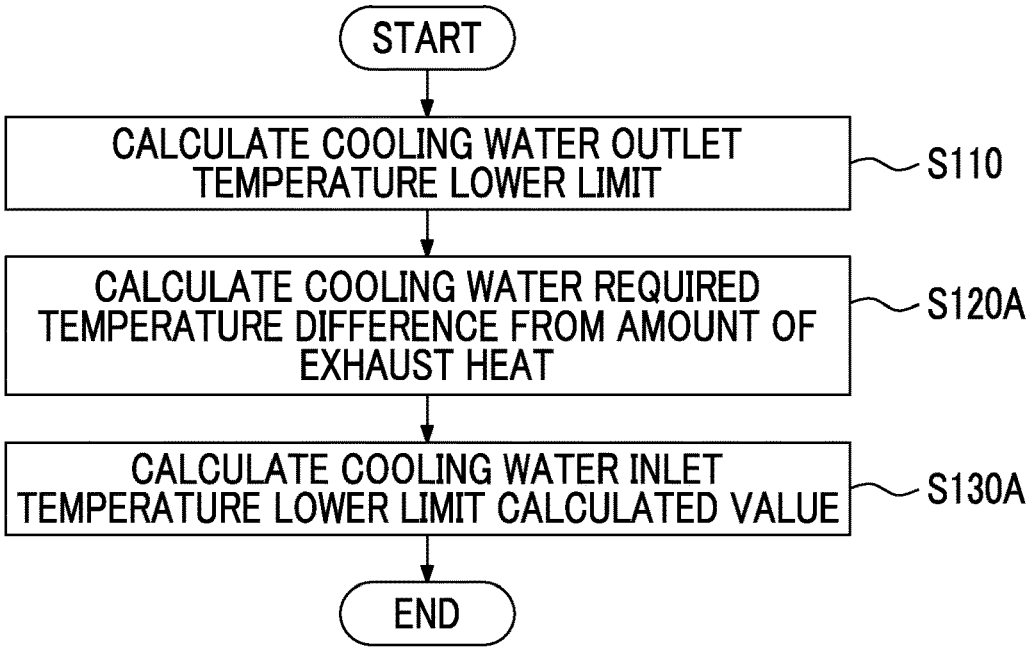
FIG. 5 is a third flowchart showing an example of the method for calculating the lower limit of the cooling water inlet temperature according to an embodiment.

FIG. 5 is a third flowchart showing an example of the method for calculating the lower limit of the cooling water inlet temperature in one embodiment.

The same reference numerals are assigned to the same processes as those described in the flowcharts of FIGS. 3 and 4, and detailed description thereof will be omitted.

First, the lower limit calculation unit 13 calculates the cooling water outlet temperature lower limit Thomin in the same manner as the process described in FIG. 3 (step S110).

Next, the lower limit calculation unit 13 calculates the cooling water required temperature difference from the amount of exhaust heat of the chiller (step S120A). The lower limit calculation unit 13 calculates the cooling water required temperature difference ΔThmin based on the amount of exhaust heat of the chiller 1 during operation by the following equation (7).

Cooling water required temperature difference $\Delta Th\text{min}''$=((Heat load $Q$+Input power of electric motor 120)÷Cooling water flow rate measured by flow meter $F2$)×Specific heat×Specific gravity) (7)

The measured value of the power meter Pin is used for the input power of the electric motor 120.

The heat load Q is calculated as follows.

Heat load $Q$=Temperature difference between cooling water inlet/outlet temperatures×Cooling water flow rate×Specific heat×Specific gravity=(Temperature measured by temperature sensor $Th$out Temperature measured by temperature sensor $Th$in)×Flow rate measured by flow meter $F2$×Specific heat×Specific gravity (8)

Next, the lower limit calculation unit 13 calculates the cooling water inlet temperature lower limit calculated value (step S130A). The lower limit calculation unit 13 calculates the lower limit calculated value Thi1 by the following equation.

Cooling water inlet temperature lower limit calculated value $Thi1$=Cooling water outlet temperature lower limit $Tho$min−Cooling water required temperature difference $\Delta Th$min (9)

As described above, it is possible to calculate the cooling water inlet temperature lower limit calculated value Thi1 according to the operating status of the chiller 1 during operation by using the cooling water inlet/outlet temperature difference according to the operating status of the chiller 1 calculated from the amount of exhaust heat of the chiller 1 during operation. Also in the method in Example 3 shown in FIG. 5, the cooling water inlet temperature lower limit calculated value Thi1 may be calculated by the following equation (9') with a value smaller by the temperature based on the safety factor D than the cooling water required temperature difference ΔThmin" calculated by the equation (7) in the same manner as in Example 2 as a cooling water required temperature difference ΔThmin'''.

Cooling water inlet temperature lower limit calculated value $Thi1$=Cooling water outlet temperature lower limit $Tho$min−Cooling water required temperature difference $\Delta Th\text{min}'''$ (9')

When the lower limit calculation unit 13 calculates the cooling water inlet temperature lower limit calculated value by any method of Examples 1 to 3, the lower limit command unit 14 determines this value as the command value of the cooling water inlet temperature lower limit (lower limit command value Thi2).

Figure 6:
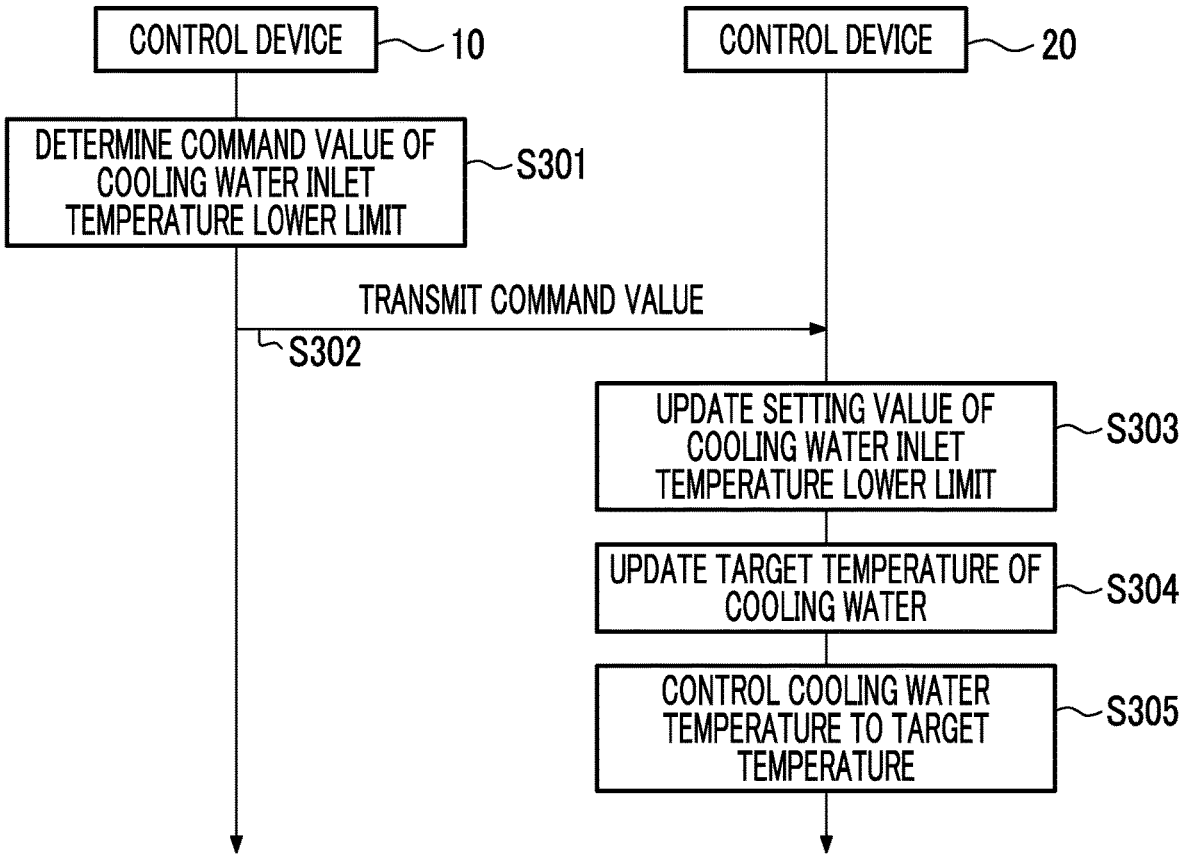
FIG. 6 is a flowchart showing an example of a control method for a heat source system according to an embodiment.

Next, a control method for the heat source system 3 using the lower limit command value Thi2 will be described. FIG. 6 is a flowchart showing an example of the control method for the heat source system according to an embodiment.

First, the control device 10 (lower limit calculation unit 13, lower limit command unit 14) determines the command value of the cooling water inlet temperature lower limit (lower limit command value Thi2) by the process described above (step S301).

Next, the communication unit 16 of the control device transmits the lower limit command value Thi2 to the control device 20 (step S302).

In the control device 20, the communication unit 23 receives the lower limit command value Thi2, and the control unit 22 updates the setting value of the cooling water inlet temperature lower limit with the received lower limit command value Thi2 (step S303).

The control unit 22 updates the target temperature of the cooling water according to the setting value of the updated cooling water inlet temperature lower limit (step S304). For example, the control unit 22 sets the temperature obtained by adding the correction value to the updated setting value of the cooling water inlet temperature lower limit (lower limit command value Thi2) as the target temperature. That is, in a case where the setting value of the cooling water inlet temperature lower limit is lowered, the target temperature of the cooling water is decreased more than before.

The control unit 22 controls the operation of the cooling tower 2 such that the temperature of the cooling water supplied to the chiller 1 is the updated target temperature of the cooling water (step S305). For example, the control unit 22 controls the fan 201, the bypass valve 202, the pump 203, and the like provided in the cooling tower 2 such that the temperature measured by the temperature sensor Thin is the target value of the cooling water. When the lower limit command value Thi2 determined by the control device 10 is lower than the predetermined lower limit setting value Thi0, the temperature of the cooling water supplied to the chiller 1 becomes lower than the temperature of the cooling water under the conventional control. Accordingly, it is possible to improve the COP of the chiller 1. The lower limit command value Thi2 may exceed the lower limit setting value Thi0 depending on the operating status of the chiller 1. In this case, the chiller 1 is not supplied with excessively cooled cooling water and thus it is possible to normally operate the chiller 1.

The process shown in the flowchart of FIG. 6 is repeated at a predetermined control cycle, and the chiller 1 is supplied with cooling water controlled to be as low as possible, which reflects the operating status of the chiller 1 in real time. Accordingly, it is possible to improve the COP of the chiller 1 as much as possible without adversely affecting the operating state of the chiller 1.

Figure 7:
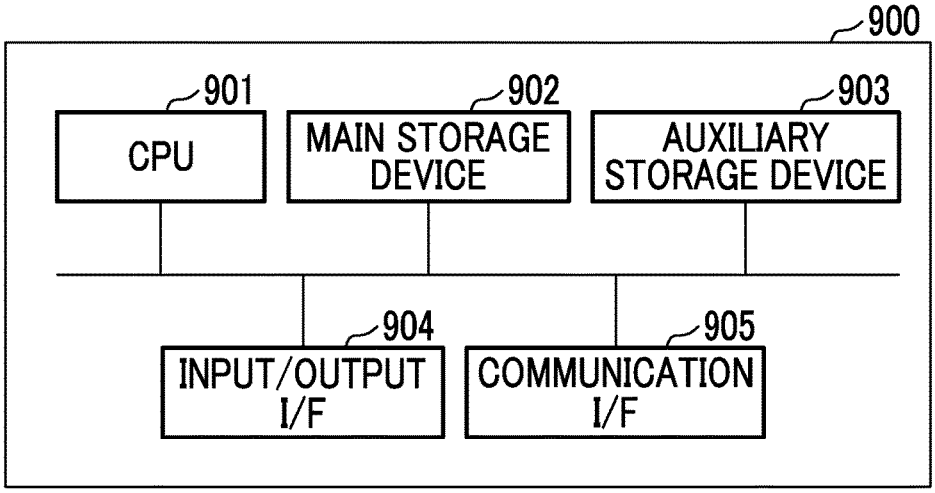
FIG. 7 is a diagram showing an example of a hardware configuration of a control device according to an embodiment.

FIG. 7 is a diagram showing an example of a hardware configuration of the control device according to an embodiment.

A computer 900 includes a CPU 901, a main storage device 902, an auxiliary storage device 903, an input/output interface 904, and a communication interface 905.

The control device 10 and the control device 20 described above are mounted on the computer 900. Each of the functions described above is stored in the auxiliary storage device 903 in a program form. The CPU 901 reads the program from the auxiliary storage device 903, expands the program in the main storage device 902, and executes the above process according to the program. The CPU 901 ensures a storage area in the main storage device 902 according to the program. The CPU 901 ensures a storage area for storing data being processed in the auxiliary storage device 903 according to the program.

The process by each functional unit may be performed by recording a program for realizing all or a part of the functions of the control device 10 and the control device 20 on a computer-readable recording medium and by causing a computer system to read the program recorded on the recording medium. The "computer system" herein includes an OS and hardware such as a peripheral device. The "computer system" also includes a homepage providing environment (or display environment) in a case where a WWW system is used. The "computer-readable recording medium" refers to a portable medium such as a CD, a DVD, or a USB, or a storage device such as a hard disk built in the computer system. In a case where this program is distributed to the computer 900 by a communication line, the computer 900 that receives the distribution may expand the program in the main storage device 902 and execute the above process. The above program may be for realizing a part of the above functions, or may further realize the above functions in combination with a program already recorded in the computer system. The control device 10 and the control device 20 may be configured of a plurality of computers 900.

Although the embodiments of the present invention have been described above, the embodiments are presented as examples and are not intended to limit the scope of the invention. These embodiments can be implemented in other various aspects, and various omissions, substitutions, and changes can be made without departing from the spirit of the invention. These embodiments and modifications thereof are included in the invention described in the claims and the equivalents thereof as well as being included in the scope and spirit of the invention.

For example, the method for calculating the cooling water inlet temperature lower limit calculated value Thi1 can be applied to a chiller provided with a refrigerant circuit other than the refrigerant circuit illustrated in FIG. 1. For example, in a case where the refrigerant circuit is provided with a compressor using magnetic bearings and does not include an oil tank, the lower limit calculated value Thi1 may be calculated by excluding the condition (equation (2)) for preventing the oil tank temperature from decreasing. Although the control device 10 of the chiller 1 determines the lower limit command value Thi2 in the above embodiment, a part or all of the functions of the lower limit calculation unit 13 and the lower limit command unit 14 may be mounted on the control device 20 of the cooling tower 2. In this case, the information required to calculate the lower limit calculated value Thi1 may be transmitted from the control device 10 to the control device 20, and the control device 20 may calculate the lower limit calculated value Thi1 or determine the lower limit command value Thi2.

The lower limit command unit 14 is an example of a lower limit determination unit. The cooling water required temperature difference ΔThmin and the cooling water required temperature difference ΔThmin' are examples of an inlet/outlet required temperature difference. The lower limit setting value Thi0 is an example of the cooling water outlet temperature lower limit setting value, the lower limit calculated value Thi1 is an example of the cooling water inlet temperature lower limit calculated value, and the lower limit command value Thi2 is an example of the cooling water inlet temperature lower limit. The chilled water outlet temperature setting value Tset is an example of the setting value of the chilled water outlet temperature. The load factor and the amount of exhaust heat are examples of the operating status.

INDUSTRIAL APPLICABILITY

With the control device, the heat source system, the method for calculating the lower limit of the cooling water inlet temperature, the control method, and the program described above, it is possible to calculate the lower limit of the cooling water inlet temperature for improving the COP of the chiller.

REFERENCE SIGNS LIST

1: chiller
2: cooling tower
3: heat source system
101: turbo compressor
102: condenser
103: subcooler
104: high-pressure expansion valve
105: economizer
106: low-pressure expansion valve
107: evaporator
108: oil tank

109: oil cooler
110: hot gas bypass valve
111: cooling heat transfer tube
112: chilled water heat transfer tube
113: hot gas bypass pipe
120: electric motor
121: first-stage compression portion
122: second-stage compression portion
201: fan
202: bypass valve
203: pump
10: control device
11: sensor information acquisition unit
12: control unit
13: lower limit calculation unit
14: lower limit command unit
15: storage unit
16: communication unit
20: control device
21: lower limit command acquisition unit
22: control unit
23: communication unit

The invention claimed is:

1. A control device that calculates a lower limit of a cooling water temperature, the control device comprising:

one or more processors configured to function as:

a lower limit calculation unit that calculates a cooling water outlet temperature lower limit obtained by adding a predetermined required temperature difference to a setting value of a chilled water outlet temperature in a chiller and an inlet/outlet required temperature difference, which is a temperature generated according to an operating status of the chiller between a cooling water outlet temperature and a cooling water inlet temperature in the chiller, and subtracts the inlet/outlet required temperature difference from the cooling water outlet temperature lower limit to calculate a cooling water inlet temperature lower limit calculated value of the chiller; and a lower limit determination unit that determines the cooling water inlet temperature lower limit calculated value as a cooling water inlet temperature lower limit, without taking into account a predetermined cooling water inlet temperature lower limit setting value set for each chiller in advance, wherein the lower limit calculation unit multiplies a predetermined cooling water rated temperature difference by a load factor calculated by dividing a value, which is obtained by multiplying a difference between an inlet temperature and an outlet temperature of chilled water cooled by the chiller by a flow rate of the chilled water, specific heat of the chilled water, and specific gravity of the chilled water, by a rated load of the chiller to calculate the inlet/outlet required temperature difference.

2. The control device according to claim 1, wherein the lower limit calculation unit multiplies a value, which is obtained by subtracting a predetermined safety factor from the load factor, by the predetermined cooling water rated temperature difference to calculate the inlet/outlet required temperature difference.

3. The control device according to claim 1, further comprising:

a lower limit command unit that commands a cooling tower that supplies the cooling water to set the cooling water inlet temperature lower limit determined by the lower limit determination unit to a lower limit of the cooling water inlet temperature.

4. The control device according to claim 3, wherein the lower limit calculation unit calculates the cooling water inlet temperature lower limit calculated value in a predetermined control cycle, and the lower limit command unit provides a command on the cooling water inlet temperature lower limit.

5. A heat source system comprising:

a chiller;

the control device according to claim 3 that controls the chiller;

a cooling tower that supplies cooling water to the chiller; and a control device of the cooling tower, wherein the control device of the cooling tower updates a target temperature of the cooling water at an inlet of the chiller based on the cooling water inlet temperature lower limit as commanded by the lower limit command unit.

6. A method for calculating a lower limit of a cooling water inlet temperature, the method comprising:

a step of a calculating cooling water outlet temperature lower limit obtained by adding a predetermined required temperature difference to a chilled water outlet temperature in a chiller;

a step of calculating an inlet/outlet required temperature difference which is a temperature generated according to an operating status of the chiller between a cooling water outlet temperature and a cooling water inlet temperature in the chiller;

a step of subtracting the inlet/outlet required temperature difference from the cooling water outlet temperature lower limit to calculate a cooling water inlet temperature lower limit calculated value of the chiller; and a step of determining the cooling water inlet temperature lower limit calculated value as a cooling water inlet temperature lower limit, without taking into account a predetermined cooling water inlet temperature lower limit setting value set for each chiller in advance, wherein, in the step of calculating an inlet/outlet required temperature difference, a predetermined cooling water rated temperature difference is multiplied by a load factor calculated by dividing a value, which is obtained by multiplying a difference between an inlet temperature and an outlet temperature of chilled water cooled by the chiller by a flow rate of the chilled water, specific heat of the chilled water, and specific gravity of the chilled water, by a rated load of the chiller to calculate the inlet/outlet required temperature difference.

7. A control method comprising:

in a heat source system including a cooling tower and a chiller, calculating a lower limit of a temperature of cooling water at an inlet of the chiller by the method for calculating the lower limit of the cooling water inlet temperature according to claim 6; and updating a target temperature of the cooling water supplied by the cooling tower at the inlet of the chiller based on the calculated lower limit.

8. A non-transitory computer-readable medium storing a program causing a computer to perform the function of:

calculating a cooling water outlet temperature lower limit obtained by adding a predetermined required temperature difference to a chilled water outlet temperature in a chiller;

calculating an inlet/outlet required temperature difference which is a temperature generated according to an operating status of the chiller between a cooling water outlet temperature and a cooling water inlet temperature in the chiller;

subtracting the inlet/outlet required temperature difference from the cooling water outlet temperature lower limit to calculate a cooling water inlet temperature lower limit calculated value of the chiller; and determining the cooling water inlet temperature lower limit calculated value as a cooling water inlet temperature lower limit, without taking into account a predetermined cooling water inlet temperature lower limit setting value set for each chiller in advance, wherein calculating an inlet/outlet required temperature difference multiplies a predetermined cooling water rated temperature difference by a load factor calculated by dividing a value, which is obtained by multiplying a difference between an inlet temperature and an outlet temperature of chilled water cooled by the chiller by a flow rate of the chilled water, specific heat of the chilled water, and specific gravity of the chilled water, by a rated load of the chiller to calculate the inlet/outlet required temperature difference.

* * * * *